United States Patent [19]

Strack et al.

[11] Patent Number: 4,891,957

[45] Date of Patent: Jan. 9, 1990

[54] STITCHBONDED MATERIAL INCLUDING ELASTOMERIC NONWOVEN FIBROUS WEB

[75] Inventors: David C. Strack, Canton; Samuel C. Baer, Roswell; Diana M. Cates, Roswell; Raju Venkatapathy, Roswell, all of Ga.

[73] Assignee: Kimberly-Clark Corporation, Neenah, Wis.

[21] Appl. No.: 319,520

[22] Filed: Mar. 2, 1989

Related U.S. Application Data

[63] Continuation of Ser. No. 64,583, Jun. 22, 1987.

[51] Int. Cl.[4] ..... D04B 23/08

[52] U.S. Cl. ..... 66/192; 66/196; 66/202; 428/284

[58] Field of Search ..... 66/190–195, 66/200, 202, 85 A, 84 A; 428/284, 230, 102, 903, 296

[56] References Cited

U.S. PATENT DOCUMENTS

| | | | |
|---|---|---|---|
| 3,619,336 | 11/1971 | Hughes | 428/102 X |
| 3,635,785 | 11/1971 | Hughes | 428/102 X |
| 3,635,786 | 1/1972 | Hughes | 66/192 |
| 3,649,428 | 3/1972 | Hughes | 66/192 |
| 4,296,163 | 10/1981 | Emi et al. | 428/284 |
| 4,631,933 | 12/1986 | Carey | 66/192 |
| 4,657,802 | 4/1987 | Morman | 428/284 X |
| 4,692,368 | 9/1987 | Taylor et al. | 428/284 |
| 4,720,415 | 1/1988 | Wielen et al. | 428/284 |

*Primary Examiner*—Ronald Feldbaum
*Attorney, Agent, or Firm*—Karl V. Sidor

[57] ABSTRACT

A stitchboard material including an elastomeric nonwoven fibrous web, e.g., an elastomeric web of meltblown fibers, and method of forming the material, is disclosed. The material, including the elastomeric web, is stretchable and has breathability, and avoids holes through the material at the location where the stitches pass through the material. The elastomeric web can be used in combination with elongatable or gatherable webs of fibrous material to provide stitchbonded stretchable composite fabrics having desired stretch and surface characteristics, and breathability, useful as fabric for wearing apparel (e.g., stretch corduroy) or other textile uses such as draperies and other home furnishings.

24 Claims, 2 Drawing Sheets

STITCHBONDED MATERIAL INCLUDING ELASTOMERIC NONWOVEN FIBROUS WEB

This application is a continuation of application Ser. No. 064,583 filed on June 22, 1987.

BACKGROUND OF THE INVENTION

The present invention relates to a stitchbonded material (e.g., a stitchbonded nonwoven fabric) that is breathable (has air permeability) and stretchable and does not have holes at the location of the stitches, and a method of making such material. More particularly, the present invention relates to such nonwoven material, including stitchbonded composite nonwoven materials, having stretchability and breathability, and which is useful for wearing apparel and other textile uses such as draperies and other home furnishings, the material having desired surface configurations and being resistant to creasing.

Fabrics having a base layer, or a plurality of layers, e.g., of nonwoven material, the layer(s) being stitchbonded with yarn, are well known in the art. For example, base layers of loose materials such as matting, an array of loose filling threads, or a layer of wadding, may be stitchbonded (that is, bound or enmeshed with the loops of a multitude of chain-stitched warp threads), to provide a fabric having coherence, tensile strength and durability.

For some time, those in the art have been attempting to provide stitchbonded nonwoven material, having desirable surface characteristics, useful as fabric in wearing apparel and other textile uses. Thus, U.S. Pat. No. 3,365,918 to Hughes discloses a simulated nonwoven corduroy fabric, obtained by stitching through a nonwoven batt with a special kind of machine that produces a ribbed construction in the batt, this stitched batt containing closely spaced apart parallel rows of chain stitches that penetrate through the batt and form parallel spaced solid ribs of fibers between the rows of stitches on the obverse side of the batt. This patent discloses that on the reverse side of the batt there are two sets of stitches, (1) diagonally extending stitch portions of one of the yarns that interconnect the parallel chains, and (2) straight line stitch portions of the other yarn. The stitching operation causes raised parallel ribs of uncompressed fibers of the fibrous batt to be formed on the obverse side of the fibrous batt, between the parallel rows of double yarn chain stitches, with the uncompressed fibers of the ribs on the obverse side being processed to produce a soft corded surface effect simulating that of conventional woven corduroy fabric.

U.S. Pat. No. 3,649,428 to Hughes discloses a stitched, composite, integrated, multilayer, nonwoven fabric, including a ribbed surface on one face. thereof to provide a bedspread appearance thereon or a corduroy appearance when used as a garment, the fabric comprising a supporting layer of a three-dimensional batt of self-bonding fibers, preferably heat-reactive, synthetic organic fibers, extending in random directions throughout the batt and being bonded to each other at the crossing points of the fibers; the fabric further comprising upper and lower three-dimensional, self-sustaining facing layers of nonwoven textile fibers superimposed on opposite sides of and contiguous with the supporting layer to completely cover the supporting layer and to form the fabric. This patent discloses that the fabric further includes elongate, spaced apart rows of stitches penetrating the superimposed layers for stitchbonding together the individual fibers of each of the upper and lower facing layers and for stitchbonding together the superimposed layer to form the composite, integrated, multilayer fabric, the rows of stitches extending, in general, in the lengthwise direction throughout the length of the fabric.

U.S. Pat. No. 4,631,933 to Carey discloses stitchbonded thermal insulating fabrics, useful in apparel, particularly for innerwear and sleepwear, blankets, bed spreads, etc., the fabric being a stitchbonded, fibrous, nonwoven web of microfibers that average about 10 micrometers or less in diameter, the web preferably having a thermal resistance of at least about 0.035 $k.m^2/watt$, air permeability of less than 1 $m^3/sec/m^2$, and tensile strength in the machine direction of at least about 15 Kg and tensile strength in the transverse direction of at least about 10 Kg, the microfibers being formed, e.g., by extruding a liquid fiber-forming material through an orifice into a high-velocity gaseous stream.

British Pat. Document No. 1,425,088 discloses a multilayer stitch-knitted fabric, including a supporting elastomeric foam layer having on one face thereof a fibrous web and on the other face a continuous fibrous layer, formed by needling fibers of the web through the supporting elastomeric foam layer, the multilayer fabric being stitchbonded by using one or more warp knitted systems of binding threads, the binding threads forming stitch wales on the other face of the stitchbonded fabric and exposed portions of wale-connecting loops on the one face of the stitchbonded fabric, imparting a quilted effect thereto. While this British patent describes disadvantages of prior bonded nonwoven fabrics utilizing a supporting elastomeric foam layer, including reduced air permeability, this patent maintains use of an elastomeric foam layer as a support, providing a different technique for mechanically bonding nonwoven textile layers to the elastomeric foam layer.

As seen in the foregoing, attempts have been made to provide stitchbonded fabrics; however, the fabrics have not been entirely satisfactory with respect to, e.g., stretchability and air permeability; moreover, the problem of unsightly holes in the formed product, which holes form due to the stitchbonding needles passing through the webs during the stitchbonding, has not been satisfactorily solved.

U.S. Pat. No. 4,657,802 to Morman discloses a composite nonwoven elastic web composed of a nonwoven elastic web joined to a fibrous nonwoven gathered web. Such composite, in its relaxed, non-stretched state, is composed of a gathered fibrous web joined to a nonwoven elastic web, with the nonwoven elastic web having been relaxed from a stretched, biased length to a relaxed, unbiased, non-stretched length so as to gather the fibrous nonwoven gathered web. The composite can be formed by forming a fibrous nonwoven gatherable web directly onto a surface of the nonwoven elastic web while the nonwoven elastic web is maintained in a stretched, biased and elongated condition. The joining of the fibrous nonwoven gatherable web to the nonwoven elastic web is achieved by heat-bonding to fuse the two webs to each other; by sonic bonding techniques; by entanglement of the individual fibers of the fibrous nonwoven gatherable web with the nonwoven elastic web; or by utilizing a tacky elastic material for the nonwoven elastic web. This patent further discloses that the nonwoven elastic web may be formed by, for example, a meltblowing process, the resulting product being a web of meltblown microfibers formed of an elastomeric material.

U.S. Pat. No. 4,593,418 to Simon discloses a leak resistant seam construction for recreational and other fabrics requiring water-resistant or waterproof properties, the stitched seam including two overlapping layers with a highly resilient, non-tacky elastomeric material tape or strip therebetween, the stitching taking place through the overlapping layers and the elastomeric tape or strip. This patent discloses that through selection of the highly resilient tape properties, the needle apertures, which form during the stitching, are substantially closed and sealed around the thread, thus greatly reducing the tendency to leak through the needle a This patent discloses that the seam structure, when employed with nonwoven fabrics, is highly effective in reducing the tendency to leak and exhibits much improved hydrohead test results. This patent further discloses that the seaming is extremely useful for recreational fabrics intended for the construction of tents, boat and trailer covers, tarpaulins and the like.

While the above-discussed documents disclose products and processes which exhibit some of the characteristics or method steps of the present invention, none of them discloses or implies the presently claimed process, or the product of the present invention. In particular, these documents do not address or solve the problems addressed in the present invention (that is, providing a stitchbonded fabric that avoids unsightly holes caused by the needles in the stitchbonding process while providing a breathable, stretchable, non-creasable fabric, having desired surface configurations.

SUMMARY OF THE INVENTION

Accordingly, it is an object of the present invention to provide a stitchbonded material, e.g., a nonwoven fabric, having breathability, and avoiding holes at the location of the stitches, and a process for producing such fabric.

It is an additional object of the present invention to provide such stitchbonded fabric, having stretch properties and desired surface configuration (e.g., a stretch corduroy material), and which has breathability and can be utilized for, e.g., wearing apparel, and a method for producing such fabric.

It is an additional object of the present invention to provide a stitchbonded composite fabric, having stretch properties, which fabric is resistant to creasing, has desired surface configuration and surface aesthetics (e.g., feel), and also is breathable yet avoids unsightly holes due to the stitching.

It is a further object of the present invention to provide such stitchbonded composite material wherein the stretch properties of the fabric are controlled to be at desired levels.

The above objectives are achieved by the present invention wherein the stitchbonded material (e.g., a stitchbonded nonwoven fabric) includes an elastomeric nonwoven fibrous web (that is, a nonwoven fibrous web formed of elastomer fibers or continuous filaments). Such elastomeric nonwoven fibrous web can be an elastomeric staple fiber web, elastomeric meltblown fiber web, elastomeric continuous filament web, or other elastomeric nonwoven fibrous web, or batts of such materials. For example, the elastomeric nonwoven fibrous web can be a spunbond continuous filament web, the spunbond web being stitchbonded to provide material of the present invention.

As another example the elastomeric nonwoven fibrous web can consist of staple elastomeric fibers, carded or air-laid, for example, to form a batt, the batt then being stitchbonded to provide material of the present invention. The batt (or web, generally), when passed to the stitch-bonding apparatus, can be self-supporting or not self-supporting, as long as it can be transferred to the stitchbonding apparatus, and stitchbonded in such apparatus.

Furthermore, the elastomeric nonwoven fibrous web can be an elastomeric meltblown web. Such meltblown web can be formed of microfibers, or the fibers can be larger than microfiber size. Such web can be a conventional elastomeric meltblown web (e.g., a self-supporting elastomeric meltblown nonwoven web), as discussed in the previously referred to U.S. Pat. No. 4,657,802 to Morman, and as discussed in U.S. Pat. No. 4,707,398, filed Oct. 15, 1986, the contents of each of which are incorporated herein by reference. By use of the elastomeric meltblown web, the stitchbonded product can be breathable.

As seen in the foregoing paragraphs, the present invention is applicable generally to elastomeric nonwoven fibrous webs (including fibrous batts) as long as such webs can be stitchbonded. While the remainder of the specification, for the most part, describes use of elastomeric meltblown webs to form the stitchbonded material, the present invention is not to be limited to elastomeric meltblown webs.

Desirably, the stitchbonded material is a stitchbonded composite produced by stitchbonding an elastomeric nonwoven fibrous web to at least one other web, such as a non-elastomeric, nonwoven web. The stitchbonded material may be comprised of a three-layer composite, with the elastic nonwoven fibrous web being the middle layer, sandwiched by, e.g., non-elastomeric, nonwoven webs. Examples of the non-elastomeric, nonwoven webs include non-elastomeric spunbond or spunlace nonwoven webs.

Where the at least one other web is gatherable or elongatable, the composite formed can be stretchable. By choice of the stitching pattern, stitching length and stitch gauge, as well as by choice of the non-elastic material and of the yarn itself, the amount of stretch in the stitchbond fabric can be controlled. Moreover, by choice of, e.g., the non-elastomeric web stitchbonded to the elastomeric nonwoven fibrous web, a stitchbonded fabric having excellent hand, drape and aesthetics can be formed.

Moreover, by choice of the stitch pattern used for the stitchbonding, the stitchbonded material can be provided with a desired surface configuration. Thus, by the present invention, a stretch corduroy material, having breathability and one-way stretch, can be achieved, and has great advantages in wearing apparel. The one-way stretch (in the non-stitched direction) is sometimes preferred in wearing apparel goods.

Furthermore, the present composite material, including an elastomeric nonwoven fibrous web (e.g., an elastomeric meltblown web) as an intermediate layer, with outer, sandwiching layers of a non-elastomeric web, is crease-resistant. In particular, the use of the intermediate elastomeric web prevents creasing of the composite, in view of the rigid attachment of the elastomeric material web to the outer layers by stitches.

Moreover, the present invention includes gathered composite materials formed by stitchbonding. Specifically, the stitchbonding can be performed with the elastomeric meltblown web being stretched, wherein after the stitch-bonding and relaxation of the stretching a gathered composite is formed.

DETAILED DESCRIPTION OF THE INVENTION

Figure 1:
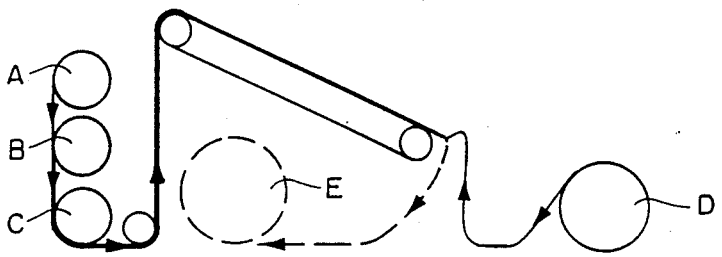
FIG. 1 is a schematic illustration of a process for forming a stitchbonded composite of the present invention.

While the invention will be described in connection with specific and preferred embodiments, it will be understood that it is not intended to limit the invention to those embodiments. On the contrary, it is intended to cover all alterations, modifications and equivalents as may be included within the spirit and scope of the invention as defined by the appended claims. Prior to more specifically describing the invention, various terms used throughout will be defined. In particular, these terms are used with respect to the elastomeric nonwoven fibrous web, and stitchbonded product, including stitchbonded composite, of the present invention.

Thus, the terms "elastic", "elastomeric", and "stretch" are used interchangeably to mean that property of any material that, upon application of a biasing force, permits that material to be stretched to a stretched, biased length which is at least about 125%, that is about 1 and ¼ times, its relaxed, unbiased length, and that will cause the material to recover at least 40% of its elongation upon release of the stretching, elongating force. A hypothetical example which would satisfy this definition of an elastomeric material would be a one (1) inch sample of a material which is elongatable to at least 1.25 inches and which, upon being elongated to 1.25 inches and released, will recover to a length of not more than 1.15 inches. Many elastic materials may be stretched by much more than 25% of their relaxed length and many of these will recover to substantially their original relaxed length upon release of the stretching, elongating force.

The term "microfibers" refers to small diameter fibers having an average diameter not greater than 200 microns, preferably having diameters in the range from about 0.5 micron to about 50 microns, more preferably having an average diameter of from about 4 microns to about 40 microns. Microfibers may be meltblown by extruding a molten thermoplastic material through a plurality of small diameter, usually circular, die capillaries as molten threads and attenuating the molten threads by application of a high velocity gas, usually air, stream to reduce their diameters to be within the range stated above. Meltblowing is a well known technique, as discussed in U.S. Pat. No. 3,849,241 to Buntin, and in U.S. Pat. No. 4,707,398 filed July 30, 1985, of Tony J. Wisneski and Michael T. Morman for "Polyolefin-Containing Extrudable Compositions and Methods for Their Formation Into Elastomeric Products", the contents of each of which is incorporated herein by reference.

Any elastomeric polymer that can be formed into filaments or fibers, formed into a web, and stitchbonded, can be used in the present invention. In particular, any elastomeric polymer that is melt blowable can be utilized for forming the elastomeric meltblown web used in the present invention. In view of the end use of the product, desirable properties of the elastomeric web include excellent stretch recovery, washability and ultraviolet light stability. A desired basis weight range for the elastomeric web, such as elastomeric meltblown web, is 17 gsm to 68 gsm, in order to optimize the properties of the final product and the cost of the end product. Examples of various elastomeric materials for use in formation of an elastomeric meltblown layer (that is, materials which can be meltblown) are described in U.S. Pat. No. 4,657,802 to Morman, the contents of which have previously been incorporated herein by reference. Specifically, such materials include polyester elastomeric materials available under the trade designation Hytrel from E.I. duPont deNemours and Co., polyurethane elastomeric material such as, for example, polyurethane elastomeric materials available under the trade designation Estane from B.F. Goodrich and Co.; polyamide elastomeric materials such as, for example, polyamide elastomeric materials available under the trade designation Pebax from the Rilsan Company; polyetherester elastomeric materials such as described in U.S. Application Ser. No. 919.287, filed Oct. 15, 1986, and previously incorporated herein by reference; elastomeric A-B-A′ block copolymers, where A and A′ are each a thermoplastic polymer end block which includes a styrenic moiety and where A may be the same thermoplastic polymer end block as A′, and where B is an elastomeric polymer midblock such as conjugated diene or a lower alkene; and blends of one or more polyolefins with elastomeric A-B-A′ block copolymer materials, as described previously. Commercially available A-B-A′ block copolymers available from Shell Chemical Company include KRATON G materials and KRATON D materials; usable materials may also be obtained from Phillips Petroleum Co. under the trade designation Solprene 418.

As indicated previously, the meltblown layer need not necessarily be formed of meltblown microfibers, although such microfibers can be used in the present invention. Specifically, the elastomeric meltblown layer (e.g., a self-supporting web) is provided so as to achieve the objectives of the present invention, including providing a stretchable fabric that is breathable, and wherein unsightly needle holes conventionally formed in stitchbonded structures are avoided.

As discussed previously, when forming a composite, the layer (or layers) other than the elastomeric nonwoven fibrous web can be of various types, depending upon the desired properties of the final fabric, and its end use applications. Thus, such additional layer(s) can be non-elastomeric or elastomeric, and can include nonwovens (such as fibrous nonwoven webs), wovens and knits. Of course, such additional layer(s.) should not unduly effect the breathability, stretchability, or other desired properties of the composite.

If the additional layers of the composite are non-elastomeric webs, and the stitchbonding is performed while the elastomeric nonwoven fibrous web is in its relaxed state, the non-elastomeric webs must have some elongation, such that the composite web is stretchable. If the elastomeric web is stretched at the time of the stitchbonding, whereby the composite formed is a gathered composite, then the additional layer(s) of the composite must be gatherable. Various gatherable fibrous nonwoven webs are described in U.S. Pat. No. 4,652,487 to Morman, the contents of which have previously been incorporated herein by reference.

As indicated previously, various materials and types of structure (e.g., knit, woven and nonwoven structure) can be utilized for the layer(s) other than the elastomeric web, in forming the composite. Of these materials, spunbond and spunlaced webs, particularly spunlaced webs, are preferred as non-elastomeric webs forming the composite. Various spunbond nonwoven webs, including materials therefor, and methods of forming such webs, are described in U.S. Pat. No. 4,340,563 to Appel, the disclosure of which patent is incorporated herein by reference. Various spunlaced nonwoven webs, including materials therefor, and methods of forming such webs, are described in U.S. Pat. No. 3,493,462 to Bunting, et al., and U.S. Pat. No. 3,485,706 to Evans, the disclosure of which patents are incorporated herein by reference. Such spunlaced webs are especially preferred because they have better elongation properties, and thus facilitate providing a composite having desired stretch properties. Particularly desirable results are achieved utilizing Sontara® for the outer layer(s). Sontara®, sold by E.I. duPont deNemours and Co., Wilmington, Delaware, is a spunlaced web of polyester fibers, and is preferred since it provides softness, abrasion resistance and better feel to the composite utilizing the elastomeric material as an intermediate layer with outer, sandwiching layers of Sontara®. Sontara® is discussed in U.S. Pat. No. 4,442,161 to Kirayoglu, et al., the contents of which patent, in connection with Sontara®, are incorporated herein by reference.

The yarns used for the stitchbonding can be any of the well-known, commercially available spun or continuous filament yarns. For apparel applications, the use of dyed yarns in stitchbonding is useful. Generally, continuous filament yarns of about 50–150 denier, preferably 90 denier, are desired.

Generally, the yarn can be either non-elastic or elastic. However, in order to provide a fabric having one-way stretch, non-elastic yarn must be used. Such use of non-elastic yarn will limit the stretch to the non-stitched direction.

Reference is made to FIG. 1 of the drawings, showing a process flow diagram for a first embodiment of the present invention wherein a composite fabric is formed, the composite fabric including three webs stitchbonded together, with the central web being an elastomeric meltblown nonwoven web, and with the outer layers being nonwoven layers. Specifically, A, B and C respectively represent rolls having thereon non-elastomeric nonwoven web material, elastomeric meltblown web material and non-elastomeric nonwoven web material. As an example, the non-elastomeric nonwoven web material can be Sontara®, a spunlaced fabric of polyester staple fibers. As can be seen in FIG. 1, the webs of non-elastic nonwoven material, elastomeric meltblown material and non-elastic nonwoven material are respectively withdrawn from the rolls A, B and C so as to provide the three non-woven webs adjacent to each other, in which form the three webs are fed to the stitchbonding machine, e.g., with even tension, and in such machine are stitched together with stitching yarn fed from roll D, shown in FIG. 1. The stitchbonded fabric is withdrawn, as shown by the broken line, and stored on roll E. Thus, the final fabric, on the roll E, consists of an intermediate elastomeric meltblown web sandwiched between two outer layers of non-elastic nonwoven webs, with the three webs being stitched together with the stitching yarn withdrawn from roll D.

Stitchbonding of the elastomeric or composite web can be carried out on known stitchbonding equipment. Particularly preferred are the "Maliwatt" machine or "Arachne" machine. Also, a Liba (West Germany) machine can be used for the stitchbonding. The two guide-bar machines are preferred because of their lapping and patterning abilities. The lapping provides increased strength and stretching in the transverse direction. Machines having a stitch gauge of 3.5 to 22 needles/25 mm are preferred for most end use applications. Twelve needles/25 mm is particularly suitable for purposes of the present invention.

The stitchbonding together of the three layers of nonwoven material (that is, outer layers of non-elastic nonwoven web and an intermediate layer of an elastomeric web) gives good laminating without use of adhesives. The stitchbonding process imparts strength and durability to the formed product, and use of yarn for laminating gives the fabric sufficient stabilization to be used in wearing apparel and other end use applications discussed previously.

Figure 2:
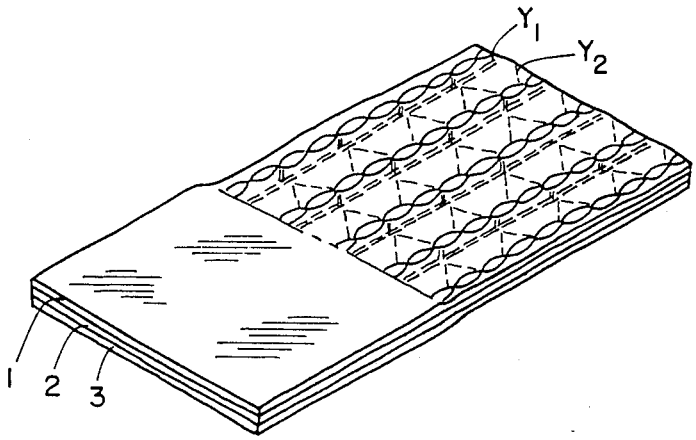
FIG. 2 is an enlarged fragmentary perspective view of one side of a composite fabric constructed according to the present invention.

The stitch pattern has an effect on the degree of stretch of the formed fabric. FIG. 2 is an enlarged fragmentary perspective view of one side of fabric constructed according to the present invention. In this FIGS., 1, 2 and 3 respectively represent the webs withdrawn from rolls A, B and C in FIG. 1. Specifically, 1 and 3 each represent the sandwiching non-elastic nonwoven layer (e.g., Sontara®), while web 2 represents the elastomeric meltblown intermediate web. $Y_1$ and $Y_2$ represent the two stitching yarns used, showing the stitching pattern of the respective yarns at one side of the fabric. As can be appreciated $Y_1$ is in the form of a chain stitch, and $Y_2$ is in the form of a tricot stitch.

Various conventional stitch patterns can be utilized within the scope of the present invention; such patterns not only effect the stretch, but also effect the fabric weight, of the formed product. Thus, use of two bar tricot stitches, for example, tend to draw in the web, or reduce the width, more than other patterns. Moreover, patterns having longer diagonal lapping generally draw in the fabric more than patterns with less diagonal lapping.

Moreover, the various stitch patterns have an effect on the surface patterning of the formed fabric. Specifically, use of a single bar chain stitch will yield a stretchable corduroy, while single bar tricot stitch can produce one or two way stretch and has good strength in both directions (machine and transverse (CD) directions). Two bar chain/tricot stitch can produce a corduroy and will have good strength in both directions, but will have stretch only in the direction across the stitching (CD direction). Two bar tricot/tricot stitch will produce a fabric with two way stretch and almost equal strength in both directions. Various other stitching patterns, known in the art, can also be used.

Figure 4:
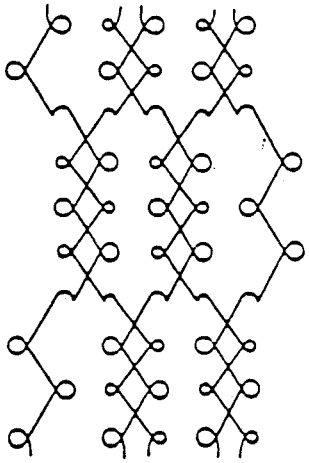
FIG. 4 is an example of another stitch pattern according to a further embodiment of the invention.

FIG. 4 shows an example of another stitch pattern used for the invention. As can be seen therein, the stitch patterns can overlap over at least portions of their length.

In view of the objects of the present invention including the forming of, e.g., a stretch corduroy material having one-way stretch, use of a two bar chain/tricot stitch, yielding a stretchable corduroy (having one-way stretch), achieves the objectives and is one of the preferred embodiments of the present invention.

Various stitch lengths can be utilized within the scope of the present invention, varying depending upon the end use application and stitch pattern used. It may also vary depending upon the number of nonwoven layers utilized with the elastomeric nonwoven fibrous web. Generally, a stitch length of about 1 mm to 3.75 mm is preferred, with a stitch length of about 2 mm particularly preferred for fabric to be used in apparel applications.

The stitchbonded material produced can have a weight basis, depending on the end use, of 75–300 gm/m$^2$, preferably 95–300 gm/m$^2$. Preferably, the stitchbonded material has a tensile strength in the machine direction of at least 15 Kg and at least 12.4 Kg in the transverse direction; a tear strength of at least 4 Kg in the machine direction and at least 0.99 Kg in the transverse direction; and a bursting strength of at least 470 KPa. Desirably, the formed product has an air permeability of 5–150 cm$^3$/cm$^2$.S, and a stretchability of 5–300%. The formed product can have applications such as apparel, fleeceware, home furnishings, and almost any application where a durable stretchable textile is desired.

A particular application is in draperies. Conventional stitchbonded web material has holes at the stitches, due to the needles used in the stitchbonding, which holes limit use of the stitchbonded web material as draperies because of light transmission through the holes. By the present invention, wherein the elastomeric nonwoven fibrous web (e.g., elastomeric meltblown web) is stitchbonded, such holes (and the disadvantages attendant thereto) are avoided. In the present invention, as the stitching needles penetrate the elastomeric web, the elastomeric fibrous material (e.g., meltblown fibers) is stretched out of the way such that after the needles withdraw from the web, e.g., the stretched fibers return to their original position and close the needle holes. As an example, in a stitchbonded structure with a 12 gauge machine at 2 mm stitching length, 186,000 holes per square yard of material will be produced in conventional stitchbonded material, but are avoided by the present invention. The ability to avoid (close) that many holes can greatly enhance the attributes and aesthetics of a stitchbonded fabric such that a stitchbonded fabric without holes will be able to compete with woven and knit textiles in aesthetics and performance, including use in draperies.

One particularly desirable apparel use for the present invention is in providing a stretch corduroy fabric. By using an elastomeric meltblown web sandwiched by spunbond non-elastomeric nonwoven webs, and using specific stitchbonding to form the stitchbonded composite, a corduroy having a "pile effect" between the stitching, can be achieved. Moreover, such corduroy fabric, formed using the elastomeric meltblown web, can be formed to have one-way stretch (that is, stretch in a direction transverse to the stitchbonding direction), which may be particularly preferred in wearing apparel.

The stitchbonded fabric of the present invention uses relatively low cost elastomeric webs, to provide a relatively low cost stretchable fabric. Commercial products, now in use, use elastomeric thread, which is expensive, and are woven or knitted, which cost more to produce than a stitchbonded structure. In this regard, while use of elastomeric thread, for forming the stitchbonded material, falls within the scope of the present invention, use of elastomeric thread is not preferred due to the high cost of such thread.

The following specific example and comparative examples illustrate the present invention, and the advantages thereof. Of course, the present invention is not limited to the example, such example merely being exemplary of the present invention.

EXAMPLE 1

Figure 3:
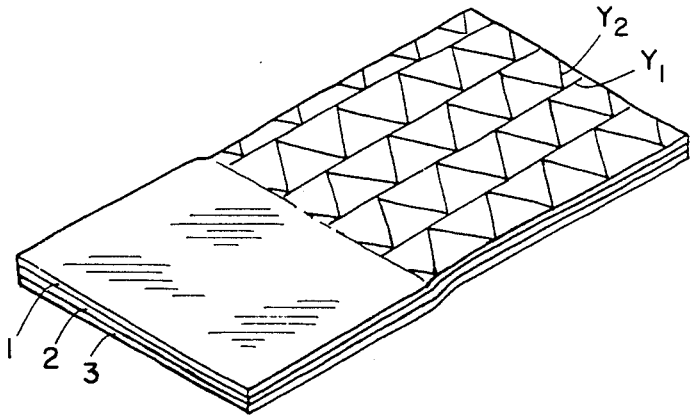
FIG. 3 is an enlarged fragmentary perspective view of the other side of the stitched fabric of FIG. 2.

A composite fibrous nonwoven web was prepared utilizing an elastomeric meltblown web of Arnitel, trade designation for a polyetherester elastomeric material from A. Schulman, Inc. of Akron, Ohio or Akzo Plastics of Arnhem, Holland. The elastomeric meltblown web was made according to procedures set forth in U.S. Pat. No. 4,707,398, filed Oct. 15, 1986, the contents of which has previously been incorporated herein by reference. The elastomeric meltblown web used had a web weight of 80 g/m$^2$, and was stitchbonded with two outer layers of Sontara® fabric (spunlaced) having a basis weight of 32 g/m$^2$. The stitch yarn used for stitching was 70 denier/32 filament polyester yarn, using a stitch configuration shown in FIGS. 2 and 3. The machine parameters are as set forth in the following Table 1.

TABLE 1

| | Example 1 |
|---|---|
| No. of bars | 2 |
| Stitch Length | 1.75 mm |
| Yarn ends/25 mm | 12 |
| Needle size | medium |

The formed composite web was then evaluated for (1) basis weight (g/m$^2$); (2) thickness (cm); (3) bulk density (g/cm$^3$); (4) grab tensile strength (ASTM 1682–64); (5) cut strip tensile strength (ASTM 1682–64); (6) cycling stretch/recovery; (7) Elmendorf tear strength (FTM-5132); (8) hydraulic bursting strength (FTM-5122); (9) Drape Stiffness (FTM-5206); and (10) air permeability (ASTM D-737).

The cycling stretch/recovery was determined in the following manner. After determination of the elastic limit of the material by the cut strip tensile strength test, the material was stretched to ⅔ of its elastic limit and relaxed, five (5) times. At the peak of the fifth cycle, the material is held in the stretched condition for one (1) minute; the load was measured at the beginning and end of the one (1) minute period. The one minute load decay is the ratio of the difference in load at the beginning and end of the one minute period to the load at the beginning of the one minute period. The material, after being held in the stretched condition for one minute, was then released, and the permanent set was determined as the ratio of the difference in length of the material between the beginning and end of the cycling to the length at the beginning of the cycling.

The results are shown in Table 2, which follows the comparative examples.

COMPARATIVE EXAMPLES 2 AND 3

In Comparative Example 2, the nonwoven composite was formed as in Example 1, except that the elastic meltblown web was replaced with an elastic film made of ethylene methylacrylate copolymer/polytrope/ethylene methylacrylate copolymer. Such film consists of a core layer (80%) of the polytrope, with sandwiching layers (10% on each side) of the ethylene methylacrylate copolymer, the film comprising a co-extrusion of the core and sandwiching layers. The ethylene methylacrylate copolymer was from Gulf Corp., resin No. 2207, and the polytrope was from Schulman Co., order #TPE-377-01. In Comparative Example 2, the basis weight of the film was 98 g/m$^2$.

In Comparative Example 3, the composite was made as in Example 1, except that the elastomeric meltblown web was replaced by an elastic film of ethylene methylacrylate copolymer/polytrope/ethylene methylacrylate copolymer, having the same relationship between core layer and sandwiching layers as above, but having a basis weight of 25 g/m$^2$.

Summarizing, the films utilized in Comparative Examples 2 and 3 were made of the same components, but the films had different basis weight, the basis weight of the film utilized in Comparative Example 2 being much larger than that of the film used in Comparative Example 3.

After formation of the composite webs in Comparative Examples 2 and 3, such webs were evaluated for the ten (10) properties set forth previously in Example 1. The results of the evaluation of the films formed in Comparative Examples 2 and 3 are also shown in the following Table 2.

TABLE 2

| Test | Units | Example 1 | Comparative Example 2 | Comparative Example 3 |
|---|---|---|---|---|
| Basis Weight | (gsm) | 183.7 | 201.5 | 121.2 |
| Thickness | (cm) | 0.128 | 0.141 | 0.142 |
| Bulk Density | g/cm$^3$ | 0.144 | 0.143 | 0.085 |
| Grab Tensile Strength (ASTM 1682-64) | | | | |
| Machine Direction Strength | Kg | 19.0 | 17.9 | 17.0 |
| Apparent Breaking Elongation | % | 29.5 | 32.1 | 22.5 |
| Transverse Direction Strength | Kg | 12.4 | 13.3 | 12.9 |
| Apparent Breaking Elongation | % | 194.9 | 177.3 | 169.3 |
| Cut Strip Tensile Strength (ASTM 1682-64) | | | | |
| Machine Direction Strength | Kg/cm | 5.25 | 4.75 | 4.78 |
| Apparent Breaking Elongation | % | 16.6 | 15.8 | 16.2 |
| Transverse Direction Strength | Kg/cm | 1.99 | 2.11 | 2.05 |
| Apparent Breaking Elongation | % | 214.9 | 168.7 | 171.4 |
| Apparent Elongation to Positive Stop (Elastic Limit | % | 155.0 | 119.6 | 122.0 |
| Cycling-Stretch/ Recovery (K-C FAE III) | | | | |
| Transverse Elongation During Test | % | 103 | 60 | 60 |
| Permanent Set | % | 31.1 | 16.0 | 17.3 |
| 1-Minute Load Decay | % | 24.4 | 16.9 | 18.4 |
| Elmendorf Tear Strength (FTM-5132) | | | | |
| Machine Direction Strength | Kg | 4.1 | 4.1 | 4.0 |
| Transverse Direction Strength | Kg | 0.99 | 1.2 | 1.1 |
| Hydraulic Bursting | KPa | 470 | 476 | 448 |

TABLE 2-continued

| Test | Units | Example 1 | Comparative Example 2 | Comparative Example 3 |
|---|---|---|---|---|
| Strength (FTM-5122) | | | | |
| Drape Stiffness (FTM-5206) | | | | |
| Machine Direction Flexural Rigidity | mg-cm | 17.0 | 4.3 | 0.77 |
| Transverse Direction Flexural Rigidity | mg-cm | 1.1 | 0.77 | 0.88 |
| Overall Flexural Rigidity | mg-cm | 4.32 | 1.82 | 0.82 |
| Air Permeability (ASTM D-737) | cm$^3$/cm$^2$.S | 43.5 | 31.5 | 24.2 |

As can be seen in Table 2, the present invention clearly provides greater air permeability (breathability) than when using elastic films. The present invention also provides greater stretchability than stitchbonded material using elastic film, as also seen in Table 2. Furthermore, other properties of the present structure including tensile strength, favorably compare with stitchbonded elastic composites utilizing an elastic film as the middle layer of a three-layer composite having Sontara ®as the outer layers.

While we have shown and described several embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

What is claimed is:

1. A stitchbonded elastomeric nonwoven fibrous web capable of being stretched to a length that is at least about 125% of its relaxed length and having an air permeability of 5–150 cm$^3$/cm$^2$ S when measured in accordance with ASTM D 737.

2. The web according to claim 1, wherein the web comprises meltblown fibers.

3. The web according to claim 2, wherein the fibers are meltblown microfibers.

4. The web according to claim 1, wherein the web is stretchable in a direction generally perpendicular to the stitches.

5. The web according to claim 4, wherein the web is stitchbonded to provide a corduroy fabric.

6. An elastomeric composite material comprising:

an elastomeric nonwoven fibrous web capable of being stretched to a length that is at least about 125% of its relaxed length; and a layer of another material stitchbonded to said web; and wherein said composite has an air permeability of 5–150 cm$^3$/cm$^2$ S when measured in accordance with ASTM D 737 .

7. The elastomeric composite according to claim 6, wherein the web is positioned between two layers of another material.

8. The elastomeric composite according to claim 8, wherein each of the two layers is a web of fibrous material.

9. The elastomeric composite according to claim 8, wherein the fibrous material is resistant to creasing.

10. The elastomeric composite according to claim 6, wherein the composite is stretchable in a direction generally perpendicular to the stitches.

11. The elastomeric composite according to claim 10, stitchbonded to provide a corduroy fabric.

12. The elastomeric composite according to claim 7, wherein each of the two layers is a spunbond nonwoven web.

13. The elastomeric composite according to claim 7, wherein each of the two layers is a spunlaced nonwoven web.

14. The elastomeric composite according to claim 13, wherein the spunlaced nonwoven webs comprise spunlaced polyester fiber fabric.

15. The elastomeric composite according to claim 7, wherein the tensile strength of the composite is at least 15 Kg in the stitchbonding machine direction and at least 12.4 Kg in the stitchbonding machine direction and at least 12.4 Kg in the direction transverse to the stitchbonding machine direction.

16. The elastomeric composite according to claim 15, wherein the tear strength of the composite is at least 4 Kg in the stitchbonding machine direction and at least 0.99 Kg in the direction transverse to the stitchbonding machine direction.

17. The elastomeric composite according to claim 15, wherein the bursting strength of the composite is at least 470 KPa.

18. The elastomeric composite according to claim 6, wherein the stitch length of the stitchbonding is about 1.0–3.75 mm.

19. The elastomeric composite according to claim 6, wherein the stitch gauge of the stichbonding is about 3.5 to 22 yarns/25 mm.

20. The web according to claim 1, wherein the web is an elastomeric spunbond web of continuous filaments.

21. The web according to claim 1, wherein the web is an elastomeric nonwoven web of staple fibers.

22. A method of forming a breathable elastomeric stitchbonded nonwoven fibrous web comprising:

stitchbonding an elastomeric nonwoven fibrous web capable of being stretched to a length that is at least about 125% of its relaxed length so as to provide an elastomeric web having an air permeability of 5–150 $cm^3/cm^2$ S when measured in accordance with ASTM D 737 that is capable of being stretched to a length that is at least about 125% of its relaxed length.

23. A method for forming a breathable nonwoven fibrous elastomeric composite material comprising:

providing an elastomeric nonwoven fibrous web capable of being stretched to a length that is at least about 125% of its relaxed length;

providing a layer of another material in juxtaposed configuration to said web; and stitchbonding the web and the other material together so that said elastomeric composite has an air permeability of 5–150 $cm^3/cm^2$ S when measured in accordance with ASTM D 737 and is capable of being stretched to a length that is at least about 125% of its relaxed length.

24. A method for forming a gathered breathable nonwoven fibrous elastomeric composite material comprising:

providing an elastomeric nonwoven fibrous web stretched to a length that is at least about 125% of its relaxed length;

providing a layer of a gatherable material in juxtaposed configuration to said web; and stitchbonding the web and the other material together;

allowing the stitchbonded composite to relax to gather said layer of gatherable material; and wherein said elastomeric composite has an air permeability of 5–150 $cm^3/cm2$ S when measured in accordance with ASTM D 737 and is capable of being stretched to a length that is at least about 125% of its relaxed length.

* * * * *

UNITED STATES PATENT AND TRADEMARK OFFICE

CERTIFICATE OF CORRECTION

PATENT NO. : 4,891,957

DATED : January 9, 1990

INVENTOR(S) : David C. Strack, Samuel C. Baer, Diana M. Cates, Raju Venkatapathy It is certified that error appears in the above—identified patent and that said Letters Patent is hereby corrected as shown below:

In the Abstract, line 1, "stitchboard" should read --stitchbonded--

Column 1, line 55, "face. thereof" should read --face thereof--

Column 3, line 15, "a This" should read --apertures. This--

Column 3, line 16, "structure," should read --structure, particularly--

Column 5, line 66, "U.S. Pat. No. 4,707,398" should read --U.S. Pat. No. 4,663,220--

Column 6, line 30, "U.S. Application Serial No. 919.287" should read --U.S. Patent No. 4,707,398--

Column 6, line 61, "layer(s.)" should read --layer(s)--

Column 11, line 57, "(Elastic Limit" should read --(Elastic Limit)--

Column 11, line 68, "Hydraulic Bursting" should read --Hydraulic Bursting--

Column 12, line 7, "Strength (FTM-5122)" should read --Strength (FTM-5122)--

Column 12, line 64, "claim 8" should read --claim 7--

UNITED STATES PATENT AND TRADEMARK OFFICE

CERTIFICATE OF CORRECTION

PATENT NO. : 4,891,957

DATED : January 9, 1990

INVENTOR(S) : David C. Strack, Samuel C. Baer, Diana M. Cates, Raju Venkatapathy It is certified that error appears in the above-identified patent and that said Letters Patent is hereby corrected as shown below:

Column 13, line 35, "stichbonding" should read --stitchbonding--

Signed and Sealed this

Sixteenth Day of March, 1993

*Attest:*

STEPHEN G. KUNIN

*Attesting Officer*

*Acting Commissioner of Patents and Trademarks*